US005129928A

United States Patent [19]

Chan et al.

[11] Patent Number: 5,129,928

[45] Date of Patent: Jul. 14, 1992

[54] ENVIRONMENT TREATMENT

[75] Inventors: Chung Chan, West Newton; Ryne C. Allen, West Roxbury, both of Mass.

[73] Assignee: Air Innovative Systems, Inc., West Newton, Mass.

[21] Appl. No.: 721,188

[22] Filed: Jun. 26, 1991

[51] Int. Cl.[5] ..... B01D 47/10; B01D 50/00

[52] U.S. Cl. ..... 55/97; 55/267; 55/316; 55/385.1; 55/417; 55/472

[58] Field of Search ..... 55/97, 316, 356, 357, 55/385.1, 417, 471–473, 267, 274, 276

[56] References Cited

U.S. PATENT DOCUMENTS

| | | | |
|---|---|---|---|
| 2,209,054 | 7/1940 | Doud et al. | 55/473 X |
| 2,243,637 | 5/1941 | Landis et al. | 55/316 |
| 2,511,497 | 6/1950 | Dauphinee | 55/385.1 |
| 2,790,510 | 4/1957 | Brabec | 55/385.1 X |
| 2,796,143 | 6/1957 | Longenecker et al. | 55/316 |
| 3,107,863 | 10/1960 | Potapenko | 240/1.4 |
| 3,239,305 | 6/1962 | Potapenko | 21/74 |
| 3,273,323 | 9/1966 | Whitfield | 55/417 X |
| 3,486,308 | 6/1967 | Burt | 55/270 |
| 3,489,607 | 1/1970 | Babcock | 134/21 |
| 3,576,593 | 4/1970 | Cicirello | 21/53 |
| 3,587,592 | 6/1971 | Price | 55/279 X |
| 3,616,624 | 11/1971 | Marsh | 55/472 |
| 3,724,172 | 4/1973 | Wood | 55/97 |
| 3,744,216 | 7/1973 | Halloran | 55/102 |
| 3,745,750 | 7/1973 | Arff | 55/102 |
| 3,757,495 | 9/1973 | Sievers | 55/279 |
| 3,838,556 | 10/1974 | Finger | 55/472 X |
| 3,923,482 | 12/1975 | Knab et al. | 55/473 X |
| 3,925,043 | 12/1975 | Matrone et al. | 55/316 X |
| 3,935,803 | 2/1976 | Bush | 55/356 X |
| 3,954,429 | 5/1976 | Van der Waaij | 55/316 X |
| 3,998,142 | 12/1976 | Foreman et al. | 55/97 X |
| 4,045,192 | 8/1977 | Eckstein | 55/222 |
| 4,109,144 | 8/1978 | Vidmar | 55/385.1 X |
| 4,210,429 | 7/1980 | Golstein | 55/279 |
| 4,280,491 | 7/1981 | Berg et al. | 55/385.1 X |
| 4,512,245 | 4/1985 | Goldman | 55/472 X |
| 4,531,956 | 7/1985 | Howorth | 55/279 |
| 4,749,385 | 6/1988 | Brunner et al. | 55/97 |
| 4,832,716 | 5/1989 | McMichael | 55/385.1 X |
| 4,894,071 | 1/1990 | Klein | 55/97 |
| 4,896,042 | 1/1990 | Humphreys | 250/435 |
| 4,909,815 | 3/1990 | Meyer | 55/316 |
| 4,955,997 | 9/1990 | Robertson, III | 55/316 |

FOREIGN PATENT DOCUMENTS

| | | | |
|---|---|---|---|
| 979768 | 12/1975 | Canada | 55/316 |
| 8800812 | 10/1989 | Netherlands | 55/385.1 |

OTHER PUBLICATIONS

Kranz, "Indoor Air Cleaning for Allergy Purposes", pp. 155–164, J. Allergy, Mar.–Apr. 1963, vol. 34, No. 2.

Zwemer et al., "Use of Laminar Control Device as Adjunct to Standard Environmental Control Measures in Symptomatic Asthmatic Children", Annals of Allergy, pp. 284–290, vol. 31, Jun. 1973.

Villaveces et al., "Use of Laminar Air Flow Portable Filter in Asthmatic Children", Annals of Allergy, pp. 399–404, vol. 38, No. 6, Jun. 1977.

*Primary Examiner*—Robert Spitzer

*Attorney, Agent, or Firm*—Fish & Richardson

[57] ABSTRACT

A system of localized low velocity laminar air flow in a recirculation path through filtering mechanisms for removing dust mites, waste and other particulate contaminants from the stream of air. That stream of air has a downwardly directed external portion in which a patient's head (particularly its mouth and nose) is adapted to be received.

18 Claims, 4 Drawing Sheets

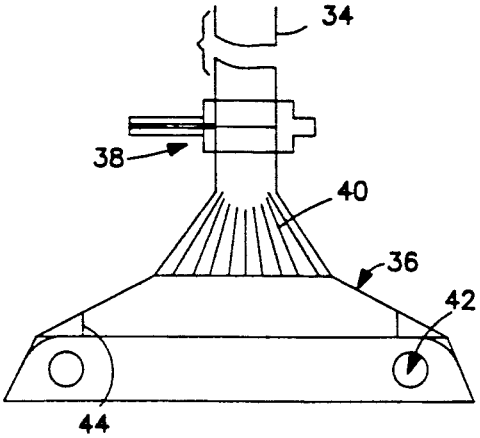
FIG. 3
FIG. 4
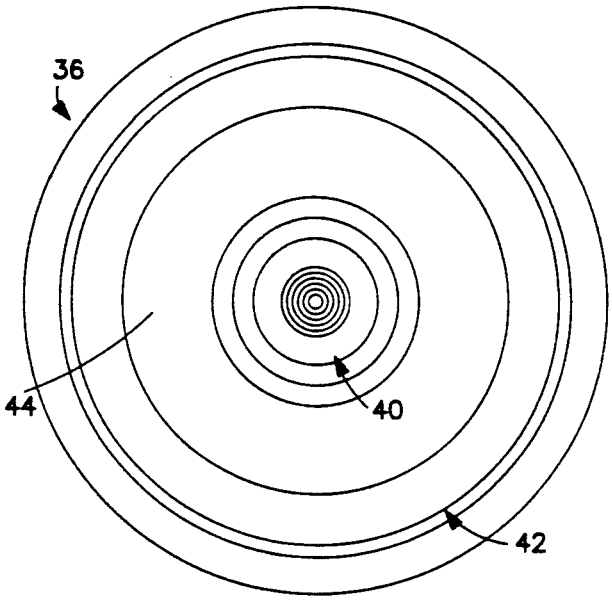
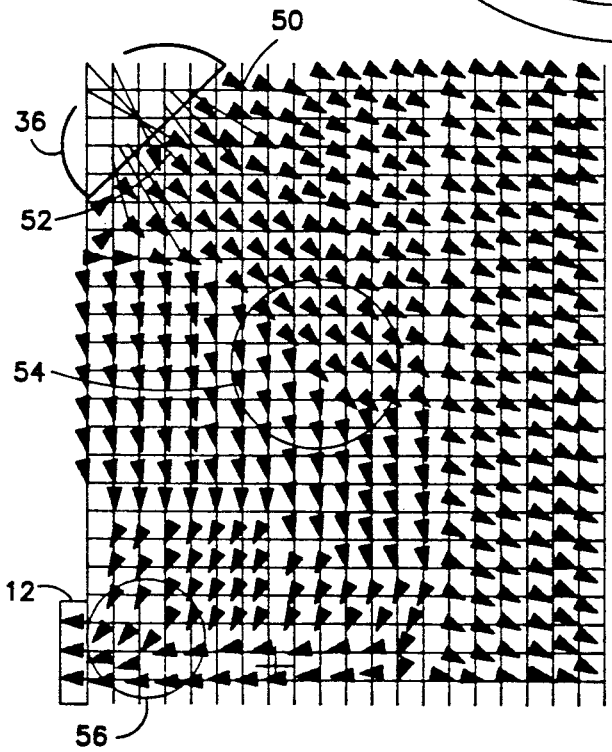
FIG. 5

ENVIRONMENT TREATMENT

This invention relates to methods and apparatus for providing environments of reduced allergen population.

Allergic respiratory disease such as allergic rhinitis or asthma affects over fifty million people in the United States. A large percentage of those patients are sensitive to a dust mite allergy. Dust mites are found in carpeting, sofas, and the like, are known to multiply rapidly, to feast on human scale, to be difficult to eradicate from carpeting and most fabrics even with careful cleaning, and to produce a waste material, in the order of one to ten micrometer in size, which resides in rugs, upholstery, mattresses, and the like, and become airborne when disturbed but remains airborne for a relatively short time (roughly thirty minutes). The potent mite allergen thrives indoors, especially where the air is warm (about 70° F.) and moist (humidity greater than 30%). As dust mites multiply rapidly and constantly produce waste excrement, efforts to deal with them by the use of acaricides or clean room technology in which air in a sealed room is constantly exchanges have not been successful. The allergens reach to both upper and lower air ways of the patient by movement of the patient itself and/or the presence of others. The lowering of a patient's accumulated exposure to the various allergens, in time, eventually improves the allergic threshold which in turn reduces symptoms of allergic rhinitis and asthma.

In accordance with one aspect of the invention, there is provided a system of localized low velocity laminar air flow in a recirculation path through filtering mechanisms for removing dust mites, waste and other particulate contaminants from the stream of air, that stream of air having a downwardly directed external portion in which a patient's head (particularly its mouth and nose) is adapted to be received. More particularly, the system is adapted to provide an environment of reduced allergen population and includes a base unit that has an air inlet, a head unit that has an air outlet of about 0.15 square meter cross sectional area, conduit structure of less than 0.01 square meter cross sectional area interconnecting the base and head units and supporting the head unit above the base unit with the air outlet directed downwardly, blower structure in the base unit for producing a laminar flow air stream from the air outlet of a velocity of less than 0.2 meter per second through a treatment zone with a cross sectional area of about 0.5 square meter spaced up to about 0.5 meter from the air outlet, and filter structure between the air outlet and air inlet for removing particles from the air stream so that the concentration of particles of greater than 0.5 micrometer size in the treatment zone is less than 20,000 per cubic foot.

In particular embodiments, the filter structure includes a high efficiency (greater than 99.9% efficient) particulate air filter that is adapted to remove particles of 0.12 micrometer and larger from the air stream; and the system optionally further includes heater structure in the base unit; valve structure for preventing particulate contamination from flowing through the conduit structure from the head unit towards the base unit when the system is deenergized; diffuser structure in the head unit adjacent the conduit structure; a light source in the head unit and a light source control in the base unit; and blower structure control in the base unit for varying the velocity of the laminar flow air stream over a range of 0.05–0.15 meters per second.

In accordance with another aspect of the invention, there is provided a process for providing an environment of reduced allergen population that includes the steps of producing a laminar flow air stream with a downwardly directed component from an air outlet at a velocity of less than 0.2 meter per second for flow through a treatment zone at a distance of up to about 0.5 meter from the air outlet, and removing particles from the air stream prior to discharge from the air outlet so that the concentration of particles of greater than 0.5 micrometer size in the treatment zone is less than 20,000 per cubic foot. Preferably, the process includes the steps of providing a head unit that has an air outlet of less than 0.15 square meter cross sectional area, and supporting the head unit so that the air outlet is facing in a downward direction.

The air stream processing apparatus may be of the stationary type or portable type and preferably provides an air stream at a velocity of about 0.1 meter per second of clean air in a flow path with an external loop portion of the air flow path that has a length of about one meter and a cross-sectional area of about 0.5 square meter.

Systems and processes in accordance with the invention provide a gentle air flow and maintain a uniformly low particle count (less than twenty thousand particles per cubic foot in a localized region of about 0.1 square meter cross-sectional area), in contrast with prior art systems which have greater fluctuation in particle count, larger quantities of particulates in the treatment region, and/or substantially greater air flow velocities.

Other features and advantages of the invention will be seen as the following description of particular embodiments progresses, in conjunction with the drawings, in which:

FIG. 3 is a sectional diagrammatic view through the head unit of the system shown in FIG. 1;

FIG. 4 is a diagrammatic bottom view of the head unit shown in FIG. 3;

FIG. 5 is a diagrammatic indication of the configuration of laminar air stream flow produced with the system shown in FIG. 1;

Figure 7A:
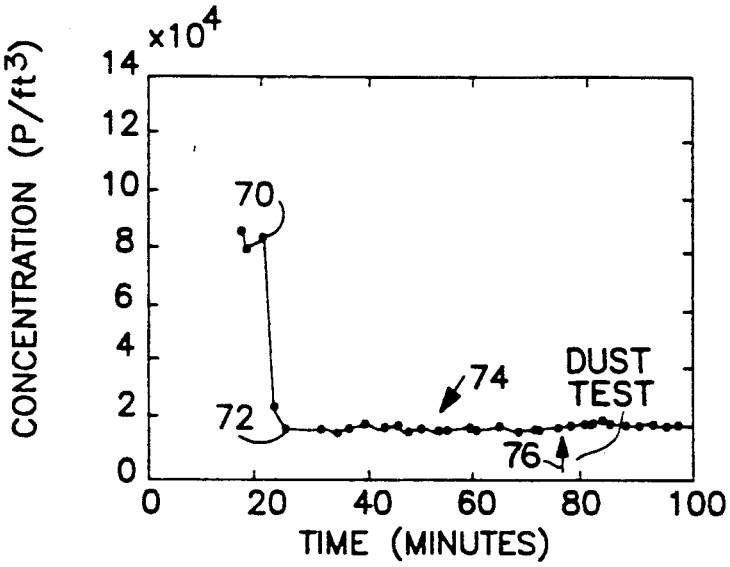
Figure 8:
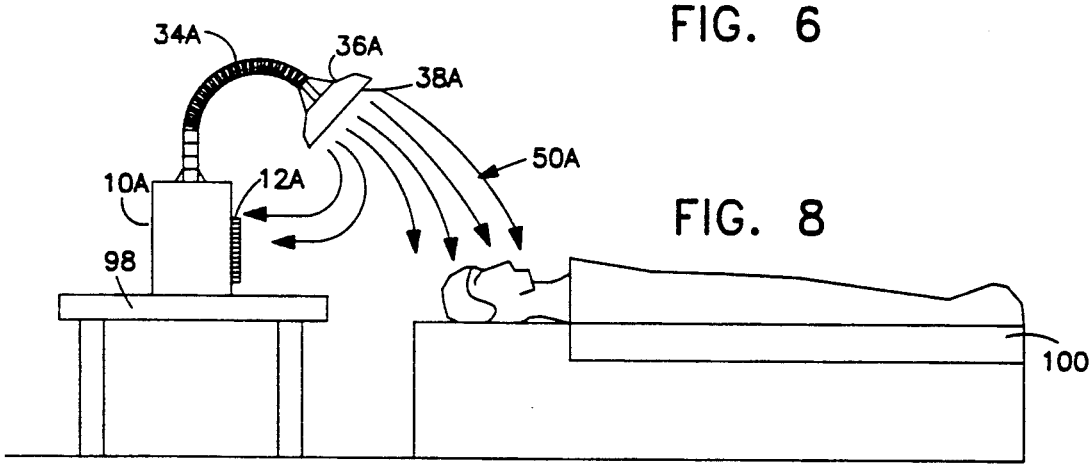

FIGS. 7*a, b*, and *c* are a comparison of operation of two prior art systems and a system in accordance with the invention;

FIG. 8 is a diagram of another system in accordance with the invention; and

Figure 9:
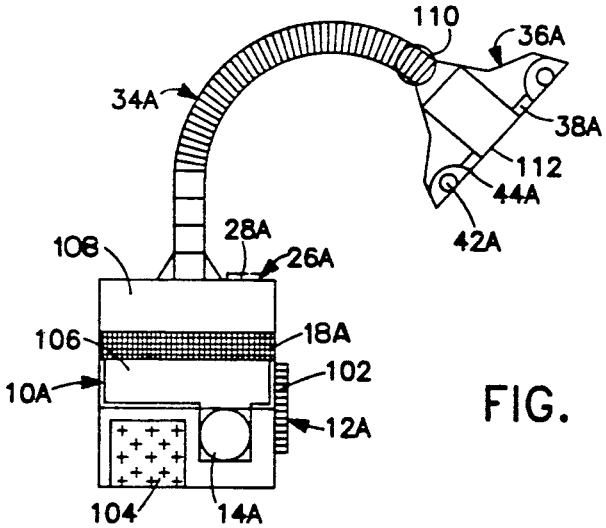

FIG. 9 is a sectional diagrammatic view through the system shown in FIG. 8.

DESCRIPTION OF PARTICULAR EMBODIMENTS

Figure 2:
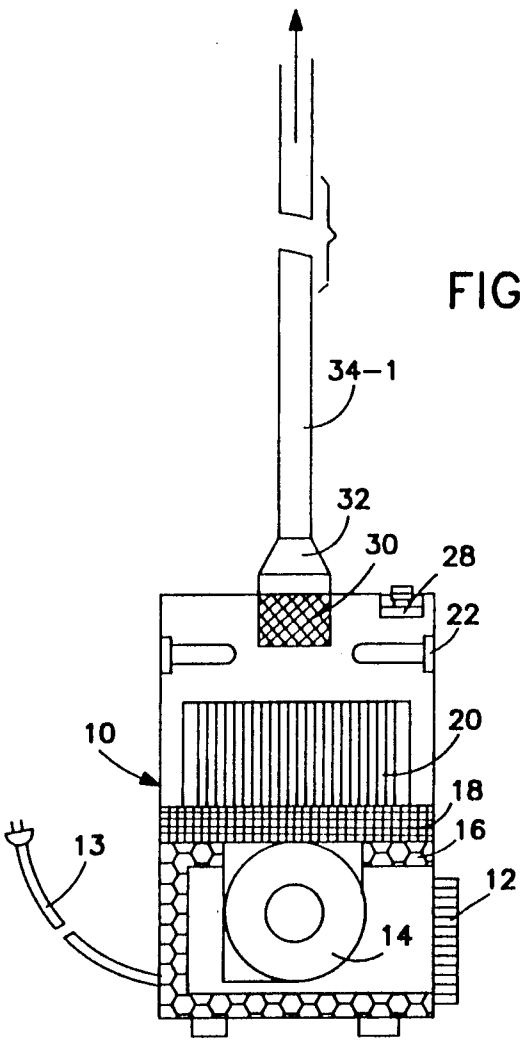
FIG. 2 is a sectional diagrammatic view through the base unit of the system shown in FIG. 1.
Figure 1:
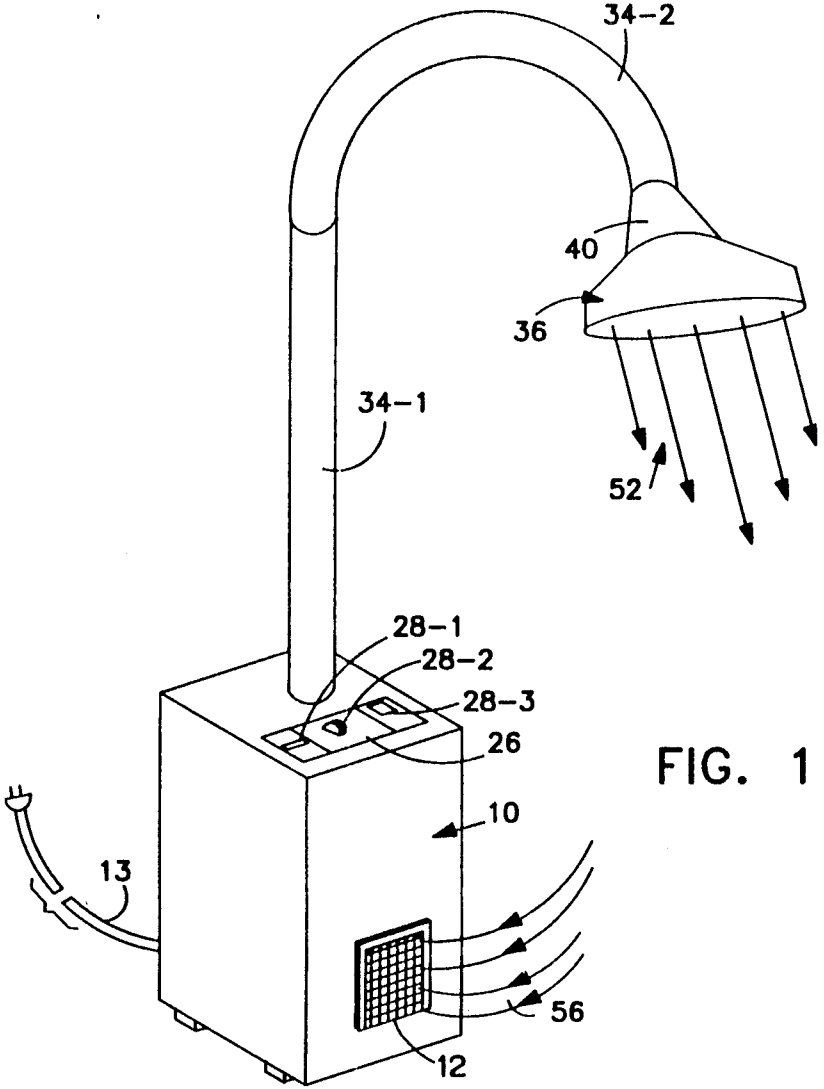
FIG. 1 is a perspective diagrammatic view of a system in accordance with the invention.

With reference to FIG. 1, the system includes base unit 10 that has a width of about 0.3 meter, a depth of about 0.3 meter, and a height of about 0.6 meter with intake port 12 and electrical power cord 13. As indicated in FIG. 2, housed in base unit 10 are variable speed fan blower 14 that is disposed in sound insulated chamber 16, washable prefilter 18, 99.999% efficient high efficiency particulate air filter unit 20 (Final Air Model 9F) of about fifteen centimeters thickness and with width and length dimensions of about twenty centimeters for removing particles of 0.12 micrometer dimension and larger, and heaters 22. Base unit 10 includes controller 26 which includes control switches 28-1, 28-2, 28-3 for turning on the light, controlling the flow velocity, etc. Unit 10 has mesh baffle 30 at outlet 32. Conduit sections 34-1 (a straight section of about five centimeters diameter and a length of about one meter), and 34-2 (a curved section of about twenty-five centimeter radius and of the same diameter) carry gate valve closure structure 38 and head unit 36 which is mounted on section 34-2.

As indicated in FIGS. 3 and 4, disposed within head unit 36 is conical diffuser unit 40, circular light unit 42, and discharge port structure 44 at about twenty centimeters diameter that is located about 1.8 meters above the floor. The head unit 36 provides a diffused low velocity flow, and closure structure 38 isolates the interior of the system from contaminated outside air when the system is not operating. Supplemental or auxiliary devices in addition to lamp 42 be incorporated in the head unit and controlled from the base unit 10.

An air stream flow diagram is shown in FIG. 5. That air stream 50 includes laminar flow portion 52 emerging from head unit 36 at a rated velocity of about 0.1 meter per second for flow in a stream of about 0.2 square meter area through treatment region 54. The air stream flow continues with diffusion from treatment region 54 along flow portion 56 to inlet region 12 over a length of about one meter. Diagrammatic indications of air flow directions are shown in FIG. 5.

Figure 6:
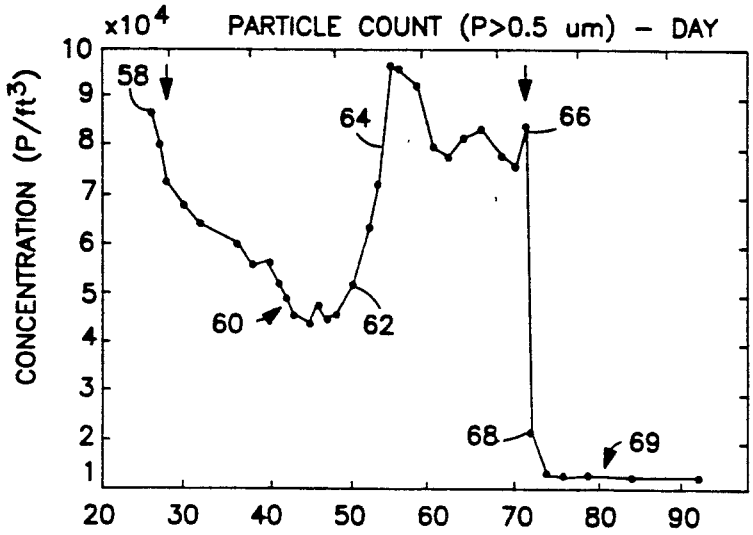
FIG. 6 is a comparison of operation of a prior art system and a system in accordance with the invention.

A commercially available system running in a 15 foot by 20 foot sealed room reduced the greater than 0.5 micrometer particle concentration (the number of particles per cubic foot as monitored by a Climet 4100-1 laser airborne particle counter and as confirmed by a Met one laser airborne particle counter) from about 85,000 (point 58) to 45,000 in about twenty minutes and remained at about 45,000 as indicated at region 60 in FIG. 6. After about fifty minutes (point 62), the commercial system was turned off and the particle count rose rapidly as indicated at 64. After about twenty minutes, a treatment system of the type shown in FIGS. 1–4 was turned on (point 66). The particle count in the air stream dropped rapidly (point 68) to less than 15,000 (about one-third of the commercial system level) and remained at that level as indicated at region 69. The treatment system of the invention produced an air stream with a particle concentration of less than one-third of the commercial system particle concentration in less than three minutes.

Another comparison of the greater than 0.5 micrometer particle concentration (the number of particles per cubic foot as monitored by a Climet 4100-1 laser airborne particle counter and as confirmed by a Met One laser airborne particle counter) for a system in accordance with the invention and two commercial systems is indicated in FIGS. 7*a*, *b*, and *c*. With reference to FIG. 7*a*, the monitored particle count was about 80,000 when the system of the invention was turned on (point 70) and was reduced rapidly (in less than three minutes) to a particle count of about 15,000 (point 72), and remained at that level (region 74), even when dust was generated (point 76).

Figure 7B:
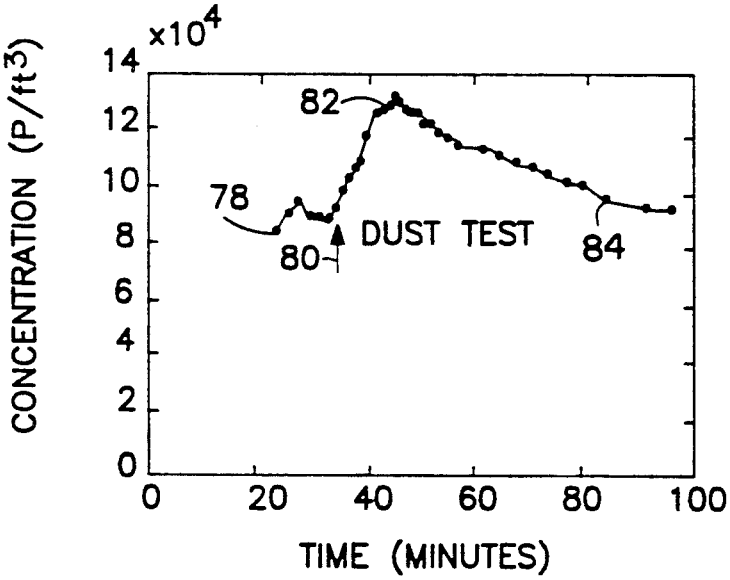
Figure 7C:
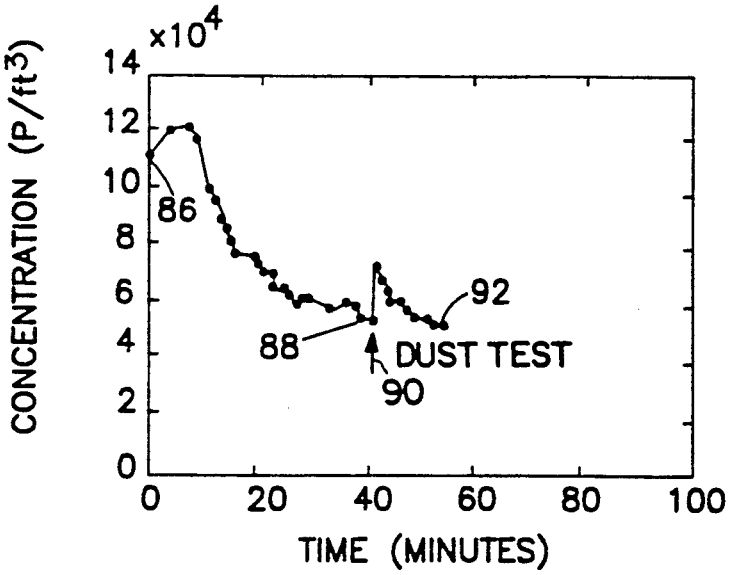

With reference to FIG. 7*b*, the monitored particle count was about 90,000 when a prior art commercial system was turned on (point 78) and remained reasonably constant until the same dust test (point 80) which caused the particle count to increase to slightly less than 140,000 (point 82) over an interval of about fifteen minutes and which then gradually returned to a particle count of about 100,000 (point 84). Thus, that commercial system has a horizontal air flow pattern which actually picks up and traps dust in the air stream for a long period. With reference to FIG. 7*c*, the monitored particle count was about 110,000 when a second prior art commercial system was turned on (point 86), the particle count was reduced to about 50,000 (point 88) over an interval of about forty minutes, the same dust test (point 90) then caused the particle count to increase to about 70,000 and then gradually return to a particle count of about 50,000 (point 92). That second commercial system thus has an air circulation pattern to clean air that is not effective in cleaning localized dust disturbances.

That low velocity clean air stream, which has a vertically downward directed component at zone 54 minimizes air turbulence and dust disturbance, creates a positive pressure zone in the breathing path of the patient located in treatment zone 54, and prevents disturbed airborne particles from entering that positive pressure zone. Since about ninety percent of airborne particles emanate from a disturbed area directly underneath the disturber, almost one hundred percent of those airborne particles will be excluded (or re-circulated into the inlet of the base unit 10) from the treatment zone 54. The relatively low air stream velocity may be directed to the patient's face for extended periods of time (up to 8–10 hours during sleeping), and that velocity can be adjusted to the individual patient's own preference by control 28-3.

FIGS. 8 and 9 are diagrammatic views of a smaller portable system with base unit 10A, conduit 34A and head unit 36A which provides a smaller zone of coverage but may be easily transported into locations where allergens may be present (such as on a table 98 adjacent bed 100, in a taxi, at a picnic area, or in a theater). With reference to FIG. 9, the system includes base unit 10A that has a width of about 0.2 meter, a depth of about 0.2 meter, and a height of about 0.2 meter with intake port 12A across which is disposed replaceable washable charcoal prefilter 102 for removing particles of several micrometers dimension. As indicated in FIG. 9, housed in base unit 10A are rechargeable battery 104, variable speed fan blower 14A, air mixing chamber 106, second prefilter 18A for removing smaller particles than filter 102, and second air mixing chamber 108. Base unit 10 also includes controller 26A which includes control switches 28A for turning on the light 42A, controlling the flow velocity, etc. Flexible air conduit 34A, of about five centimeters diameter and a length of about one meter, is coupled to head unit 36A by articulated joint structure 110. Disposed within head unit 36A are cylindrical high efficiency particulate air filter unit 112 of about 0.1 meter diameter and 0.1 meter length for removing particles of 0.12 micrometer dimension and larger from the air stream, circular light unit 42A, and discharge port structure 44A of about 0.15 meter diameter that is adapted to be closed by iris closure valve 38A. The head unit 36A provides a diffused low velocity flow 50A, and closure structure 38A isolates the interior of the system from contaminated outside air when the system is not operating.

While particular embodiments of the invention have been shown and described, various modifications will be apparent to those skilled in the art, and therefore, it is not intended that the invention be limited to the disclosed embodiment, or to details thereof, and departures may be made therefrom within the spirit and scope of the invention.

What is claimed is:

1. A process for providing an environment of reduced allergen population comprising the steps of producing a laminar flow air stream that has a vertically downward directed component from an air outlet at a velocity of less than 0.2 meter per second through a treatment zone disposed below said air outlet at a distance of 0.5 meter from said air outlet, and removing particles from said air stream prior to discharge from said air outlet so that the concentration of particles of greater than 0.5 micrometer size in said treatment zone is less than 20,000 per cubic foot.

2. The process of claim 1 and further including the steps of providing a head unit that has an air outlet of less than 0.15 square meter cross sectional area, and supporting said head unit so that said air outlet is facing in a downward direction.

3. A system for providing an environment of reduced allergen population comprising a base unit that has an air inlet, a head unit that has an air outlet of less than 0.15 square meter cross sectional area, conduit structure of less than 0.01 square meter cross sectional area interconnecting said base and head units and supporting said head unit above said base unit with said air outlet directed downwardly, blower structure in said base unit for producing a laminar flow air stream from said air outlet of a velocity of less than one meter per second through a treatment zone with a cross sectional area of about 0.5 square meter spaced 0.5 meter from said air outlet, and filter structure between said air inlet and said air outlet for removing particles from said air stream so that the concentration of particles of greater than 0.5 micrometer size in said treatment zone is less than 20,000 per cubic foot.

4. The system of claim 3 wherein said filter structure is adapted to remove particles of 0.12 micrometer and larger from said air stream.

5. The system of claim 3 wherein said filter structure is in said base unit.

6. The system of claim 3 wherein said filter structure is in said head unit.

7. The system of claim 3 and further including heater structure in said base unit.

8. The system of claim 3 and further including valve structure for preventing particulate contamination from flowing through said conduit structure from said head unit towards said base unit when said system is deenergized.

9. The system of claim 8 wherein said valve structure is of the gate type.

10. The system of claim 8 wherein said valve structure is of the iris type.

11. The system of claim 8 wherein said valve structure is adjacent said air outlet.

12. The system of claim 3 and further including diffuser structure in said head unit adjacent said conduit structure.

13. The system of claim 12 and further including a light source in said head unit and a light source control in said base unit.

14. The system of claim 3 and further including blower structure control in said base unit for varying the velocity of said laminar flow air stream over a range of 0.05–0.15 meters per second.

15. The system of claim 14 and further including primary filter structure in said air inlet, and valve structure disposed between said air outlet and said base unit for preventing particulate contamination from flowing through said conduit structure from said head unit towards said base unit when said system is deenergized.

16. The system of claim 15 wherein said filter structure is adapted to remove particles of 0.12 micrometer and larger from said air stream.

17. The system of claim 16 and further including a light source in said head unit and a light source control in said base unit.

18. The system of claim 17 and further including a rechargeable battery is said base unit for powering said blower structure.

* * * * *